US008375678B1

(12) United States Patent
Ferrer

(10) Patent No.: US 8,375,678 B1
(45) Date of Patent: Feb. 19, 2013

(54) METHODS FOR CONSTRUCTION OF PRE-FABRICATED MODULAR REINFORCEMENT CAGES FOR CONCRETE STRUCTURES

(76) Inventor: Felix E. Ferrer, Cliffside Park, NJ (US)

( * ) Notice: Subject to any disclaimer, the term of this patent is extended or adjusted under 35 U.S.C. 154(b) by 0 days.

(21) Appl. No.: 13/397,520

(22) Filed: Feb. 15, 2012

Related U.S. Application Data

(62) Division of application No. 12/568,395, filed on Sep. 28, 2009.

(51) Int. Cl.
*E04B 1/00* (2006.01)

(52) U.S. Cl. ..... 52/745.17; 52/649.3; 52/849; 52/649.1; 52/646; 52/414; 52/426; 52/836; 52/854

(58) Field of Classification Search ..... 52/649.3, 52/649.1, 649.2, 649.7, 649.8, 645, 646, 52/648.1, 686, 745.17, 414, 426, 836, 854, 52/252, 253, 649.6, 849; 249/53 R, 53 M
See application file for complete search history.

(56) References Cited

U.S. PATENT DOCUMENTS

| | | | | | |
|---|---|---|---|---|---|
| 865,336 | A | * | 9/1907 | Gardener | 52/236.8 |
| 1,079,829 | A | * | 11/1913 | Bennett | 52/372 |
| 1,115,490 | A | | 11/1914 | Bindley | |
| 1,666,157 | A | | 4/1928 | Voskamp | |
| 1,911,957 | A | | 5/1933 | Kassmir | |
| 1,963,057 | A | | 6/1934 | Wilcox | |
| 2,019,195 | A | | 10/1935 | Simpson | |
| 2,523,131 | A | | 9/1950 | Martin | |
| 2,921,462 | A | | 1/1960 | Wilson | |
| 3,245,190 | A | | 4/1966 | Reiland | |
| 3,261,135 | A | * | 7/1966 | Knabe | 52/127.12 |
| 3,270,471 | A | * | 9/1966 | Middendorf | 52/223.13 |
| 3,367,084 | A | | 2/1968 | Reiland | |
| 3,382,680 | A | * | 5/1968 | Takano | 405/252 |
| 3,473,285 | A | * | 10/1969 | Reiland | 52/745.17 |
| RE27,732 | E | * | 8/1973 | Van Buren | 52/223.4 |
| 3,957,087 | A | * | 5/1976 | Johnston | 138/178 |
| 4,467,583 | A | * | 8/1984 | Hasak | 52/649.4 |
| 4,472,331 | A | * | 9/1984 | Kida | 264/31 |
| 4,644,726 | A | * | 2/1987 | Wheeler | 52/677 |
| 4,900,193 | A | * | 2/1990 | MacKinnon | 405/252 |
| 5,044,136 | A | * | 9/1991 | Liu | 52/252 |
| 5,359,829 | A | | 11/1994 | Voita | |
| 5,392,580 | A | | 2/1995 | Baumann | |
| 5,410,847 | A | * | 5/1995 | Okawa et al. | 52/272 |
| 5,491,941 | A | | 2/1996 | Lancelot, III | |
| 5,561,956 | A | * | 10/1996 | Englekirk et al. | 52/223.13 |
| 5,746,555 | A | * | 5/1998 | McEvoy | 411/14 |
| 5,826,387 | A | * | 10/1998 | Henderson et al. | 52/295 |
| 5,961,253 | A | * | 10/1999 | Okawa | 405/239 |
| 6,293,071 | B1 | | 9/2001 | Konstantinidis | |
| 6,643,945 | B1 | | 11/2003 | Starks | |
| 6,659,135 | B2 | | 12/2003 | Sorkin | |

(Continued)

FOREIGN PATENT DOCUMENTS

GB 2229466 A 9/1990

*Primary Examiner* — Joshua J Michener
*Assistant Examiner* — Matthew Gitlin
(74) *Attorney, Agent, or Firm* — Kenyon and Kenyon LLP

(57) ABSTRACT

A pre-fabrication of a modular reinforcement cage for high-rise concrete construction is provided. The primary vertical bars, often referred to as the longitudinal bars, are held in formation by a set of templates that are manufactured to the design of the construction. These templates ensure accurate placement of the vertical bars and provides great rigidity for the module when being placed in the field. The main vertical bars can have thread-like deformations along the length of the bar, and are locked in place by use of compatible hardware against the templates. Multiple modules can then be stacked and coupled by use of mechanical couplings as construction continues.

13 Claims, 4 Drawing Sheets

U.S. PATENT DOCUMENTS

| | | | | |
|---|---|---|---|---|
| 6,775,954 | B1 | 8/2004 | Sorkin | |
| 6,832,456 | B1 | 12/2004 | Bilowol | |
| 7,191,528 | B2 | 3/2007 | Smith et al. | |
| 7,310,920 | B2 | 12/2007 | Hovey, Jr. | |
| 7,353,617 | B1 | 4/2008 | Simones et al. | |
| 7,374,369 | B2 * | 5/2008 | Jakubowski et al. | 405/244 |
| 7,392,624 | B2 | 7/2008 | Kinzer | |
| 7,533,505 | B2 | 5/2009 | Henderson | |
| 7,735,273 | B2 * | 6/2010 | Knepp et al. | 52/294 |
| 7,878,730 | B2 * | 2/2011 | Weaver | 403/305 |
| 7,905,066 | B2 * | 3/2011 | Pryor et al. | 52/223.14 |
| 2007/0269273 | A1 * | 11/2007 | Henderson | 405/239 |
| 2007/0294969 | A1 | 12/2007 | Kim et al. | |
| 2009/0100784 | A1 | 4/2009 | Garza et al. | |
| 2009/0145074 | A1 | 6/2009 | Tsukamoto | |
| 2011/0061321 | A1 * | 3/2011 | Phuly | 52/297 |

* cited by examiner

METHODS FOR CONSTRUCTION OF PRE-FABRICATED MODULAR REINFORCEMENT CAGES FOR CONCRETE STRUCTURES

CROSS REFERENCE TO PRIORITY APPLICATION

This application is a division of U.S. application Ser. No. 12/568,395, filed Sep. 28, 2009, which is incorporated herein by reference in its entirety.

BACKGROUND OF THE INVENTION

1. Field of the Invention

The present invention relates generally to building construction technologies. In particular, the present invention is directed to reinforcements for primary compression/tension members of high-rise concrete structures, such as columns and shear walls. The present invention also provides a method for the construction of high-rise concrete structures and elements of those structures.

2. Description of the Prior Art

As concrete structures become taller and slimmer, contractors face many new challenges in the construction field. Higher strength values are being required for concrete compression/tension members, requiring increased amounts of reinforcing steel. In multi-level concrete construction, it is a common construction practice to place vertical and horizontal steel reinforcement rods individually. It is also common practice in engineering and design that primary concrete members use steel grades of typically 60 ksi (Grade 60), and #11 (1.410" nominal diameter) vertical longitudinal bars. That standard is based on the fact that an individual worker can be expected to pick up a single piece of the #11 rebar size, and be able to properly handle the weight of the bar. After the placement of the vertical bars, a worker would then place horizontal ties to attach the horizontal and vertical bars, as is standard practice. Once the grid or plurality of reinforcement rods is placed, a formwork or other means to contain the fluid form concrete having the desired dimensions is placed around the reinforcement. Concrete is then poured and vibrated as per standard practice to eliminate voids.

There are many externalities associated with the common standard practice of field placing standard steel reinforcements, including, but not limited to lack of quality of construction, very loose tolerances, consumption of large amounts of time for field work, use of valuable work space in field, lap splices, congestion of mass quantities of steel, problems associated with concrete placement with large quantities of steel, and field environment issues impacting workmanship.

As a result, the prior art has concentrated on the issues related to the placement of reinforcement steel for concrete structures. For example U.S. Pat. No. 5,392,580 to Baumann discloses a generally rectangular wire grid of welded construction that defines and maintains the position of rebar charged through the grid for the formation of structural column and girder cages. Pre-positioned ties are used to guide the rebar through the grid. The pre-positioned ties are then tightened such that the rebar is held firmly in place at the close tolerance positions defined by the prefabricated grid. As will be understood by those skilled in the art, the tightened ties prevent the spinning or rotation of the rebar. A plurality of such grids can be assembled into expandable bundles that may be expanded in an accordion-like fashion about the rebar, resulting in spaced grids for defining and maintaining the position of the rebar.

U.S. Pat. No. 5,359,829 to Voita discloses a method and apparatus for fabricating a drilled, concrete pier in the earth at a construction site. A template is provided, and vertical reinforcement bars are suspended from the template, generally defining the periphery of a reinforcement cage. Horizontal ties are then positioned at selected sides along the length of the reinforcement bars, and are fastened to the vertical reinforcement bars. Once concrete is poured to form the concrete pier, the template is removed from the reinforcement cage.

Other modular cages involve continuous, spiral like, formed steel to act as the primary confining element and the aligning element.

SUMMARY OF THE INVENTION

The invention is directed to a prefabricated construction reinforcement. The prefabricated construction reinforcement comprises at least one module, where each module comprises a plurality of templates, each template defining a plurality of apertures through the template, a plurality of sections of rebar, each section of rebar positioned in an aperture of at least one of the templates, at least one holding mechanism on each of the rebar sections, the holding mechanism in contact with a template, and positioned on the rebar sections to hold a template in a fixed position along the rebar section length while allowing the rebar section to spin freely within the aperture.

Preferably, the rebar is externally threaded, and the holding mechanism of the prefabricated construction reinforcement comprises at least one threaded fastener threaded onto external threads of the section of rebar, and in contact with template. More preferably, the threaded fastener is a lock nut. Although not typically required, a washer can be used with the locknut. To facilitate contact with the threaded fastener, that portion of the template that contacts the threaded fastener is preferably generally flat. More preferably, the entire template is generally flat. Preferably, the template is formed from a single piece of material. Preferably, each template has a pair of opposing faces, where face need not be rectangular, but can be of any useful shape.

Typically, a portion of the rebar sections have a holding mechanism on each side of at least one template, and a portion of the rebar sections have a holding mechanism on only one side of at least one template.

Generally at least a portion of the apertures are unthreaded. That allows the rebar sections to spin or rotate freely in the apertures of the templates.

Alternatively, each holding mechanism can be clamped onto the rebar, such as with a clam shell type clamp, and/or fixed in position on the rebar with a locking mechanism. Preferably, the locking mechanism is at least one setscrew. Where the holding mechanism is clamped onto the rebar and/or fixed in position on the rebar with a locking mechanism, the rebar need not be threaded. In addition, where the locking mechanism is at least one setscrew or similar fastener, the rebar may further comprise a slot or groove into which the locking mechanism is fixed.

In accordance with the invention, The prefabricated construction reinforcement can further comprise a plurality of couplers. Each coupler is fixed onto an end of a section of rebar in a first module, and fixed onto an end of a section of rebar in a second module, connecting the two modules. Preferably, the connected sections have staggered lengths.

Preferably, the rebar is externally threaded, the couplers are internally threaded, and internally threaded couplers are threaded onto the end of the section of rebar in the first module and the end of the section of rebar in the second module, connecting the two modules. The coupler can be an internally threaded end of the section of rebar in the second module.

Alternatively, each coupler is clamped onto the rebar, such as with a clam shell type clamp, and/or fixed in position on the rebar with a locking mechanism. Preferably, the locking mechanism is at least one setscrew. Where the coupler is clamped onto the rebar and/or fixed in position on the rebar with a locking mechanism, the rebar and couplers need not be threaded.

The prefabricated construction reinforcement of the invention may further comprise a confinement. Preferably, the confinement comprises sections of rebar.

The invention also provides a load bearing compression/tension member, comprising a solidified aggregate construction material formed around a prefabricated construction reinforcement, the prefabricated construction reinforcement comprising at least one module, where each module comprises a plurality of templates, each template defining a plurality of apertures through the template. The module comprises a plurality of sections of rebar, each section of rebar positioned in an aperture of at least one of the templates, and at least one holding mechanism on each of the rebar sections, the holding mechanism in contact with a template, and positioned on the rebar sections to hold the template in a fixed position along the rebar section length, while allowing the rebar section to spin within the aperture prior to forming the solidified aggregate construction material around the prefabricated construction reinforcement.

The invention also provides a method for assembling a prefabricated construction reinforcement. The method comprises constructing at least one module by providing at least two templates, each template defining a plurality of apertures through the template, inserting sections of rebar through at least a portion of the apertures in each template, positioning at least one holding mechanism on each of the rebar sections in contact with one face of a template, and securing the holding mechanisms in place on the rebar sections, thereby holding the templates in a fixed position along the rebar section length, while allowing the rebar section to spin within the aperture. Preferably, the method further comprises positioning adjacent sections of rebar in the templates to stagger the rebar ends by a predetermined amount. The method of the invention may further comprise initially positioning the sections of rebar with a temporary template, then placing permanent templates on the sections of rebar, and locking the templates in place with the holding mechanisms.

Preferably, the method further comprises constructing a first module and a second module, abutting the rebar section ends of the first module with rebar section ends of the second module, positioning couplers onto the abutted rebar sections, and fixing the couplers onto the abutted rebar sections, connecting the modules. Preferably, the rebar sections are provided with external threads and the couplers are provided with internal threads. The threaded couplers are positioned onto rebar sections of the first module, and the threaded couplers on the rebar sections of the first module are partially threaded onto abutting rebar section ends of the second module, connecting the first and second modules.

Alternatively, the coupler can be clamped onto the rebar, such as with a clam shell type clamp, and/or fixed onto the coupler in position on the rebar with a locking mechanism.

The invention also provides a method for preparing a load bearing compression/tension member. The method comprises constructing a prefabricated construction reinforcement, comprising at least one module, by providing at least two templates, each template defining a plurality of apertures through the template, inserting sections of rebar through at least a portion of the apertures in each template, positioning at least one holding mechanism on each of the rebar sections, and in contact with at least one face of a template, and securing the holding mechanisms in place on the rebar sections, thereby holding the templates in a fixed position along the rebar section length while allowing the rebar section to spin within the aperture, thereby constructing the at least one module. Then, the at least one module is placed into a form, an aggregate material is poured into the form around the module, and the aggregate material is allowed to harden. Preferably, the aggregate material is concrete.

DETAILED DESCRIPTION OF THE INVENTION

As used herein, the term "rebar" refers to a metal bar, preferably steel, for reinforcing concrete. The longitudinal bars of the present invention are preferably steel rebar. As also used herein, the term "aggregate material" refers to any aggregate construction material, including, but not limited to concrete and cement.

The present invention provides a prefabricated construction reinforcement that overcomes many of the deficiencies of the prior art. The present invention further provides a load bearing compression/tension member, comprising the prefabricated reinforcement, and methods of assembling prefabricated reinforcements of the invention and preparing load bearing compression/tension members. The primary assembly of the module contains a multitude of compatible components.

Figure 1:
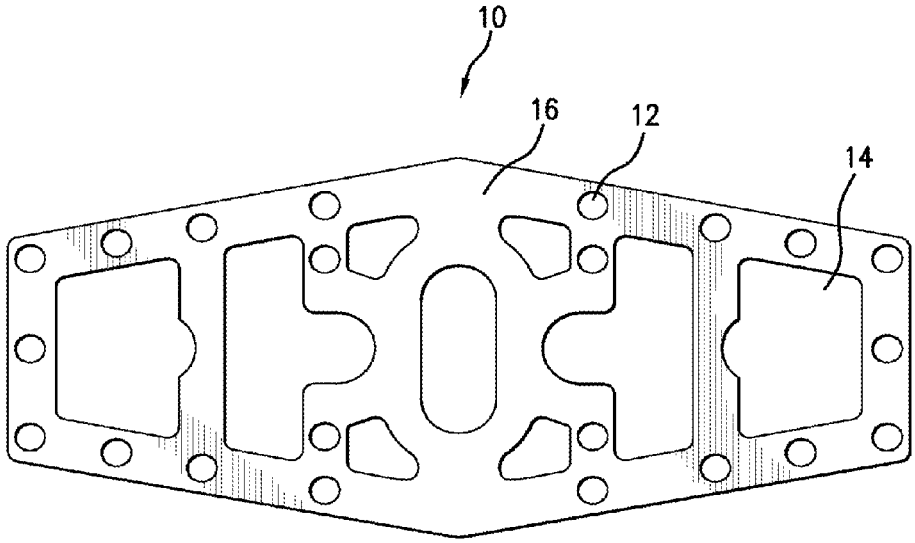
FIG. 1 illustrates a template in accordance with the invention.

A template 10 of the prefabricated construction reinforcement of the invention is illustrated FIG. 1. The template functions as a structural frame, defining the dimensions of the prefabricated construction reinforcement, and positioning longitudinal bars. Preferably, the template is manufactured out of steel plate, but any material having sufficient strength can be used. Typically, the template has a shape that corresponds to the design of the construction that is reinforced by the prefabricated construction reinforcement.

As illustrated in FIG. 1, a template 10 of the invention defines apertures 12, preferably dimensioned to allow sections of rebar 22 (see FIGS. 2 to 4) to be inserted through each aperture 12. The template 10 also defines one or more openings 14 to allow concrete to pass through the template 10 to fill a form in the desired shape of a reinforced construction. The template 10 has a pair of opposed faces, i.e., an upper face 16 and a lower face (not shown) 18.

Typically, the sections of rebar 22 are positioned vertically, and the template is positioned horizontally when the prefabricated construction reinforcement placement is used in a construction. Thus, the sections of rebar may also be referred to a vertical or longitudinal bars. The placement of the rebar sections is pre-determined by design, and translated into a cutting mechanism to form the template 10. A number of holes or apertures 12 is cut into the template that will hold and align sections of rebar 22 that are later charged through the aperture 12. The aperture 12, thus, has a pre-determined tolerance to allow the bar to easily pass with its greatest dimension, and to spin or rotate while inserted in the aperture. The apertures are preferably not threaded, such that there is no need to thread the rebar 22 into the template 10. Instead, the apertures 12 are preferably dimensioned to allow the rebar 22 to pass through the aperture, and allow the bar to spin or rotate while inserted in the aperture. The number of holes, size of holes, thickness of template, size, shape, and geometry of the template are all determined by the design of construction and the design of the module. Because of the infinite nature of design, each template and each module cage system are typically custom tailored for each designed structure.

Figure 2:
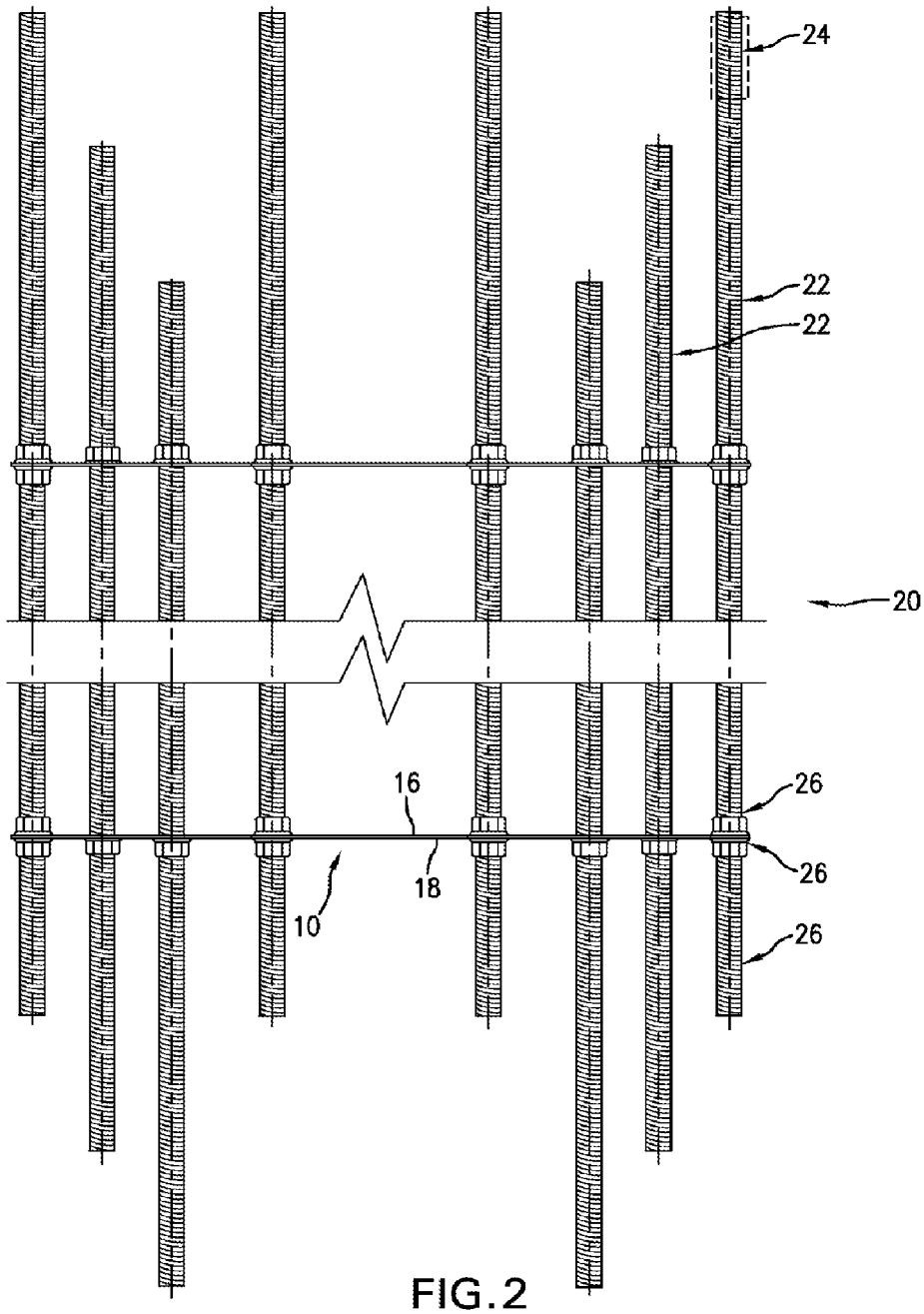
FIG. 2 illustrates a side view of a module in accordance with the invention.

The structure of a module 20 of the invention is generally illustrated in FIG. 2. The longitudinal bar or the primary vertical reinforcement, i.e., the rebar 22, preferably has a continuous thread-like deformation 24 along the length of the bar, where the thread is more preferably substantially along the entire length of each bar. There are numerous manufacturers in the market that supply the thread bar material, such as SAS Stressteel, Inc., of Fairfield, N.J. It will be understood by those skilled in the art that any thread bar material that meets the design requirements of a particular construction project can be used in the modules of the invention.

Preferably, rebar used in the present invention is a high-strength steel grade, and, more preferably, has a larger than standard diameter. As will be understood by those skilled in the art, however, any grade steel or any size bar, as the bar meets the design requirements of the construction, can be used in the modules of the invention. Useful threaded bars include, but are not limited to, steel bar sizes of #14, #16, #18, #20 and #24. Preferably, the grade of the steel used in the invention is Grade 97 or 97 ksi (97,000 psi) at a minimum. The lengths of the bars are determined by the design of the construction, however typically a fully assembled module will span a two (2) floor height.

Figure 3:
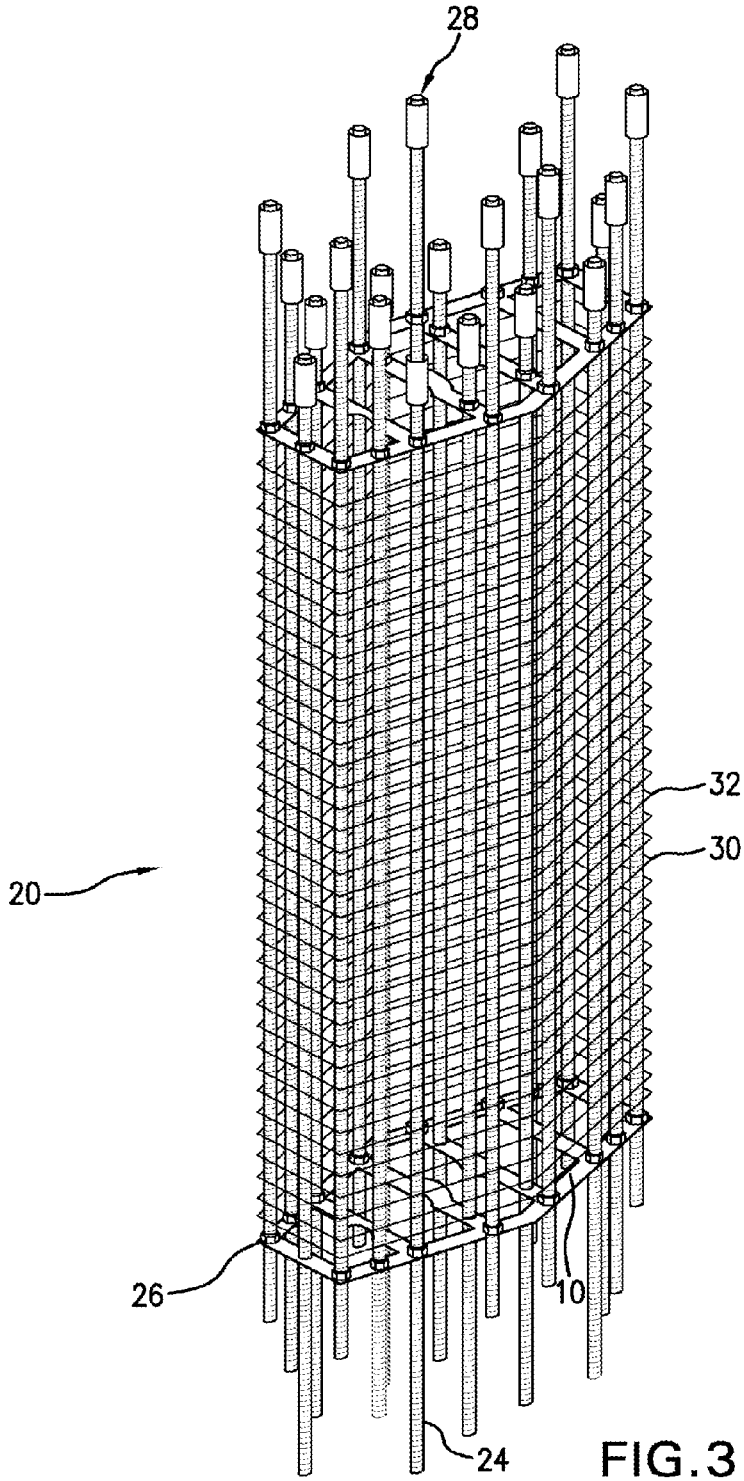
FIG. 3 illustrates a perspective view of a module in accordance with the invention.

As illustrated in FIGS. 2 and 3, the holding mechanisms used to lock the longitudinal bars in place against the template 10 are in the form of nuts 26. Preferably, the holding mechanisms are lock nuts, compatible with the thread-like deformations 24 that run the along the length of the longitudinal bar. Compatibility of the components facilitates the positioning and assembly of the bars in the module, as the bars can be cut to any length without compromising threadability. The lock nuts 26 are preferably threaded onto the longitudinal bars 22, and tightened against one of the faces 16 and 18 of the template 10, once the location of the longitudinal bar 22 is set.

As illustrated in FIGS. 3 and 4, couplers 28, which also are compatible with the longitudinal thread-like deformations 24, are preferably used to attach one module to a second module. As the modules are attached via mechanical couplings 28, all lap splicing in field is eliminated, providing a large savings in material by allowing the ends of the longitudinal bars to abut.

The modules of the invention preferably comprise horizontal steel bars, also known as the confinement. This confinement 30, as illustrated in FIG. 3, can be part of the pre-assembly, or can be installed in the field. Preferably, the confinement ties 30 are installed as part of the pre-assembly of the modules off the job site. Preferably, the confinement ties are formed from rebar. However, other means of confinement may be used with the present invention.

Typically, as discussed, the design of the module cage is predetermined by the design of the structural element to be formed in the construction and its associated requirements. The design basis of the module includes, but is not limited to, the strength of the steel required for the anticipated loadings of the concrete member, the geometry of the final outer surface of the concrete member, the geometry of the longitudinal bar layout, and the diameter of the individual bars. Various computer software packages are available for use in the design development phase.

Once a detail design is prepared, the design layout is translated to physical form and the template is manufactured according to the design required by the desired construction. Computer Numerically Controlled (CNC) machinery is preferably used to manufacture the template. CNC machinery accurately cuts the steel with high precision. As will be understood by those skilled in the art, various forms of CNC are available today, and alternate types of manufacture, such as forging, and casting, can be used without deviating from the scope of this invention.

The module is preferably assembled in a horizontal position, and, more preferably, in a closed or controlled climate environment. Typically two (2) or three (3) templates are used for the fabrication of the module. However, the number of templates used will be determined by design choices. During assembly, the longitudinal bars 22 are charged, i.e., inserted, through the apertures 12 in the templates 10, as illustrated in FIGS. 2 and 3. Adjacent longitudinal bars are typically staggered at the ends by a pre-determined length, alleviating the potential for cracking the concrete at coupled locations. Primary bars are typically chosen of the plurality of longitudinal bars to aid in the fabrication and lifting of the final assembled module. These primary bars will have a lock nut 26 on both sides or faces 16 and 18 of the template to hold the template in location. Preferably, the other longitudinal bars are charged through the holes in the template, properly located for the stagger, and threaded with a lock nut on only one side of the template to hold the bar in place. As long as the lock nuts are both on the outside faces of the template or both on the inside faces of the template, the bars will be held in place. Preferably, the lock nuts are both on the outside faces of the template.

Preferably, the lock nuts also have an internal locking mechanism to ensure the lock nut will not rattle loose during transport, movements, or installation. This typically is in the form of a small screw that is tapped through the side of the nut, i.e., "set screw". After the lock nut is threaded up against the template, the set screw is tightened, keeping the lock nut in place. The process of charging the longitudinal bars through the template(s) and locking bars in proper location by means of lock nuts is repeated until the whole module is complete in accordance with the initial design.

Modules can also be assembled using a temporary template. The longitudinal bars are first located in position with the temporary template. Permanent templates are then placed onto the longitudinal bars, and locked in position with the lock nuts.

The primary assembly of the module cage, using the larger diameter bars and the steel templates, creates a highly rigid assembly. As the apertures are not typically threaded, the longitudinal bars are held in a longitudinal dimension, and are capable of spinning at that location. Allowing the bar to spin while not changing the longitudinal location is an important concept within the invention, facilitating the joining of modules. Preferably, the bar can spin freely while not changing its longitudinal location, as discussed below.

As illustrated in FIG. 3, to allow each longitudinal bar 22 to spin or rotate freely on its axis when confinement ties 30 are present, an additional component 32 is added. In contrast to the present invention, the standard practice of attaching confinement ties 30 to the longitudinal bars 22 would prevent or at least inhibit the free rotation or spinning of the longitudinal bars. For use with confinement ties 30, the modules of the present invention further comprise a non-structural element 32 that spans between templates 10. The non-structural element can be a steel cable, small diameter rebar, or other suitable component, which is connected to the end templates. The horizontal spacing of the confinement is pre-determined by design, and installed onto the module. The attachment of the confinement ties 30 is made between the ties and the additional spanning bar component 32 between the templates, ensuring that the confinement is properly tied off as per typical standard practice, while allowing the longitudinal threaded bars to spin freely.

The modules, prior to shipment to field, are verified and checked for proper assembly, and are preferably color coded at the ends to aid in ease of construction in field. The modules are shipped to the structure site, lifted by crane using the primary longitudinal bars described above, and placed in the appropriate location. Because of the large diameter bars and the steel templates, the module allows little or no deflection or deformation in geometry during the lifting and installation process, which typically occurs in other pre-assembled reinforcement cages. The lower module is placed in location, formwork is assembled surrounding the cage, and concrete is poured. In alignment with the project schedule, the next module is then brought in after a pre-determined curing time of the concrete.

An upper cage is then brought in, aligning the bars to abut. Preferably, to limit the amount of time operating the crane required to place the modules, a limited number of bars are on the upper cage are first attached to the second cage. Preferably, the corner bars of the upper and lower cages are first attached, locking in and stabilizing the upper cage. The corner bars are typically sufficient to at least temporarily support and stabilize the upper cage on the lower cage, allowing the release of the crane. This allows the crane used for a subsequent task, such as lifting an additional cage, while workers attach and lock in the remaining bars, as described below.

Figure 4D:
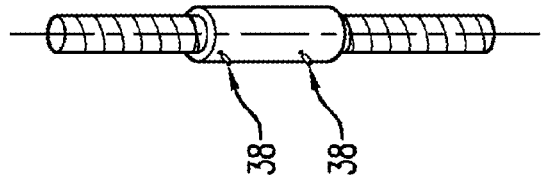
FIG. 4 illustrates the connection of rebar sections in two modules in accordance with the invention.
Figure 4C:
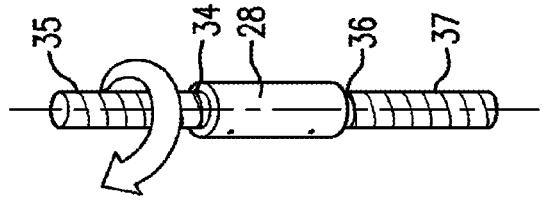
Figure 4B:
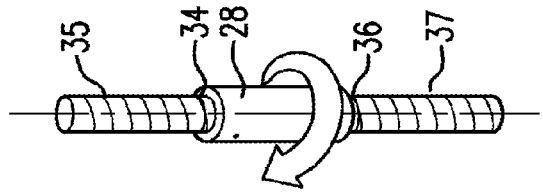
Figure 4A:
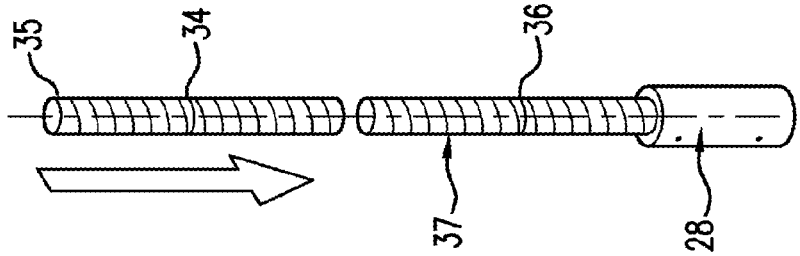

As illustrated in FIG. 4A, a coupler 28 is typically placed onto one of the bars 22 in each pair of longitudinal bars that are to be connected before the bars of the upper and lower cages are abutted. The outermost bars are adjusted via spinning to properly align the threading of the bars. Preferably, the final position 34 of the upper end of the coupler 28 is marked on the upper bar 35, and the final position 36 of the lower end of the coupler 28 is marked on the lower bar 37. As illustrated in FIG. 4B, the coupler 28 is back-spun partially off the bar on which it is positioned, and partially onto the end of the abutted bar until half of the coupler 28 is threaded onto each of the bars 35 and 37. As illustrated in FIG. 4C, the upper bar 35 is then torqued with a wrench mechanism to engage the threading of the bars and the coupler. As illustrated in FIG. 4D, the coupler also preferably comprises small set screws 38, similar to those preferably used with the lock nuts, which alleviate any potential loosening or movement during the concrete installation process.

Preferably, the modules of the invention are assembled to span a two (2) floor height, and can vary by design. Common practice in the multiple story concrete industry is that an entire floor slab must be laid out in steel, formed, and poured in single floor lifts. With the present invention, the contractor can now phase the construction so that they can stagger the construction of the floors. This staggered construction technique, due to the modules spanning two (2) floors, rapidly increases productivity for floor by floor construction.

What is claimed is:

1. A method for assembling a prefabricated construction reinforcement, the method comprising:

constructing at least one self-supporting module by:

providing at least two templates, each template defining a plurality of apertures through the template;

inserting reinforcement bars configured for tension and compression loading through at least a portion of the apertures in each template, each reinforcement bar adapted to be in direct contact with aggregate material;

positioning at least one holding mechanism on each of the reinforcement bars, the at least one holding mechanism in contact with a face of a template; and securing the holding mechanisms in place on the reinforcement bars, thereby holding the templates in a fixed position along the reinforcement bar length while allowing the reinforcement bar to spin within the aperture.

2. The method according to claim 1, further comprising positioning adjacent reinforcement bars in the templates to stagger the reinforcement bar ends.

3. The method according to claim 1, further comprising initially positioning the reinforcement bars with a temporary template, then placing permanent templates on the reinforcement bars, and locking the templates in place with the holding mechanisms.

4. The method according to claim 1, further comprising constructing a first self-supporting module and a second self-supporting module;

abutting the reinforcement bar ends of the first self-supporting module with reinforcement bar ends of the second self-supporting module;

positioning couplers onto the abutted reinforcement bars; and fixing the couplers onto the abutted reinforcement bars, connecting the modules.

5. The method according to claim 4, further comprising providing the reinforcement bars with external threads and the couplers with internal threads;

positioning threaded couplers onto reinforcement bars of the first self-supporting module; and threading the threaded couplers on the reinforcement bars of the first self-supporting module partially onto abutting reinforcement bar ends of the second self-supporting module, connecting the first and second self-supporting modules.

6. The method according to claim 4, further comprising clamping the coupler onto the reinforcement bar and/or fixing the coupler in position on the reinforcement bar with a locking mechanism.

7. A method for preparing a load bearing compression/tension member, the method comprising:

constructing a prefabricated construction reinforcement, comprising at least one self-supporting module, by:

providing at least two templates, each template defining a plurality of apertures through the template;

inserting reinforcement bars configured for tension and compression loading through at least a portion of the apertures in each template, each reinforcement bar adapted to be in direct contact with an aggregate material;

positioning at least one holding mechanism on each of the reinforcement bars in contact with at least one face of a template; and securing the holding mechanisms in place on the reinforcement bars, thereby holding the templates in a fixed position along the reinforcement bar length while allowing the reinforcement bar to spin within the aperture, thereby constructing the at least one self-supporting module;

placing the at least one self-supporting module into a form;

pouring the aggregate material into the form around the self-supporting module; and allowing the aggregate material to harden.

8. The method according to claim 7, wherein the aggregate material is concrete.

9. The method according to claim 7, further comprising positioning adjacent reinforcement bars to stagger the reinforcement bar ends.

10. A method for preparing a load bearing compression/tension member, the method comprising:

constructing at least two self-supporting modules of construction reinforcement, the at least two self-supporting modules comprising a first self-supporting module and a second self-supporting module;

wherein constructing the first self-supporting module comprises:

providing a first plurality of templates, each template defining a plurality of aperture through the template;

inserting a first plurality reinforcement bars configured for tension and compression loading through at least a portion of the apertures in each template, each reinforcement bar adapted to be in direct contact with an aggregate construction material;

positioning at least one holding mechanism on each of the reinforcement bars in contact with at least one face of a template; and securing the holding mechanisms in place on the reinforcement bars, thereby holding the templates in a fixed position along the reinforcement bar length while allowing the reinforcement bar to spin within the aperture, thereby constructing the first self-supporting module;

wherein constructing the second self-supporting module comprises:

providing a second plurality of templates, each template defining a plurality of aperture through the template;

inserting a second plurality of reinforcement bars configured for tension and compression loading through at least a portion of the apertures in each template, each reinforcement bar adapted to be in direct contact with an aggregate construction material;

positioning at least one holding mechanism on each of the reinforcement bars in contact with at least one face of a template; and securing the holding mechanisms in place on the reinforcement bars, thereby holding the templates in a fixed position along the reinforcement bar length while allowing the reinforcement bar to spin within the aperture, thereby constructing the second self-supporting module;

wherein at least one of the second plurality of reinforcement bars is positioned in alignment with at least one of the first plurality of reinforcement bars; and wherein at least one coupler is clamped to each of the aligned reinforcement bars.

11. The method according to claim 10, further comprising:

placing the at least two self-supporting modules into a form; and pouring solidified aggregate material into the form; and allowing the aggregate material to harden.

12. The method according to claim 10, further comprising color coding at least one of the second plurality of reinforcement bars and at least one of the first plurality of reinforcement bars prior to alignment.

13. The method according to claim 10, further comprising marking the final position of the at least one coupler on the aligned reinforcement bars.

* * * * *